US007258557B2

(12) United States Patent
Matsubara et al.

(10) Patent No.: US 7,258,557 B2
(45) Date of Patent: Aug. 21, 2007

(54) PIVOTAL LEVER-TYPE CONNECTOR

(75) Inventors: Kuninori Matsubara, Makinohara (JP); Masao Nagano, Makinohara (JP); Michiko Watanabe, Makinohara (JP)

(73) Assignee: Yazaki Corporation, Tokyo (JP)

( * ) Notice: Subject to any disclaimer, the term of this patent is extended or adjusted under 35 U.S.C. 154(b) by 116 days.

(21) Appl. No.: 11/483,006

(22) Filed: Jul. 10, 2006

(65) Prior Publication Data

US 2007/0026706 A1 Feb. 1, 2007

(30) Foreign Application Priority Data

Jul. 29, 2005 (JP) ..... P2005-221375

(51) Int. Cl.
*H01R 13/62* (2006.01)

(52) U.S. Cl. ..... 439/157; 439/372

(58) Field of Classification Search ..... 439/157, 439/160, 372

See application file for complete search history.

(56) References Cited

U.S. PATENT DOCUMENTS 5,575,671 A * 11/1996 Katsuma ..... 439/157
6,264,485 B1 * 7/2001 Saka et al. ..... 439/157
6,328,582 B1 * 12/2001 Fukamachi ..... 439/157
6,644,992 B2 * 11/2003 Maegawa ..... 439/157
6,655,971 B2 * 12/2003 Maegawa ..... 439/157
6,755,674 B2 * 6/2004 Fujii et al. ..... 439/157
7,066,747 B2 * 6/2006 Nagano et al. ..... 439/157

FOREIGN PATENT DOCUMENTS

JP 2003-264035 A 9/2003
JP 2003-264036 A 9/2003

* cited by examiner

*Primary Examiner*—X. Chung-Trans
(74) *Attorney, Agent, or Firm*—Sughrue Mion, PLLC

(57) ABSTRACT

In a pivotal lever-type connector, a pivotal lever includes a metallic pivotal lever body which is disposed generally in straddling relation to a hood portion of a female connector housing, and can be engaged with engagement projections of a male connector housing, and a synthetic resin-made pivotal movement operating portion mounted on the pivotal lever body to cover a pivotally-moving end portion of the pivotal lever body. The pivotal movement operating portion has synthetic resin-made elastic retaining arms molded integrally with a body of this operating portion.

1 Claim, 13 Drawing Sheets

PIVOTAL LEVER-TYPE CONNECTOR

BACKGROUND OF THE INVENTION

1. Field of the Invention

This invention relates to a pivotal lever-type connector in which female and male connectors are fitted together by pivotally moving a pivotal lever.

2. Related Art

There is known one conventional pivotal lever-type connector having a pair of cancellation portions for elastically deforming elastic retaining piece portions of a pivotal lever (see, for example, JP-A-2003-264035 and JP-A-2003-264036).

In the pivotal lever-type connector disclosed in JP-A-2003-264035 and JP-A-2003-264036, a provisionally-fitting operation for fitting a male housing a predetermined depth into a female housing is effected before the female and male housings are completely fitted together. At the time of provisionally fitting the female and male housings together, a slanting surface of each cam groove is pressed by a corresponding cam pin entering an inlet of the cam groove, so that a component force is applied to the pivotal lever in a direction of pivotal movement thereof, and therefore the pivotal lever is pivotally displaced from an initial position toward a fitting position. When the pivotal lever is pivotally moved from the initial position toward the fitting position, an operating portion moves away from an outer surface of a hood portion, and projects laterally, and therefore the fact that the pivotal lever has been pivotally displaced can be clearly viewed and confirmed from the exterior. Then, when the female and male housings reach a provisionally-fitting depth, each cam pin abuts against a left arcuate surface, and therefore is prevented to a certain degree from further moving deeper. Even if the cam pin further moves deeper from this condition while the cam pin abuts against the arcuate surface, the pivotal lever is merely pivotally moved, and the fitting of the female and male housings will not proceed. Then, when the pivotal lever is pivotally moved into a predetermined position, each cam pin abuts against a projecting portion, and therefore the pivotal lever is prevented from being further pivotally moved, thereby preventing the cam pin from being displaced toward a curved surface. Each projecting portion has a mountain-like shape having two slanting side surfaces, and therefore in the provisionally-fitted condition, when an operating force of above a predetermined value is applied to the pivotal lever to pivotally move this pivotal lever toward the fitting position, the cam pin slides over the projecting portion to be displaced toward the curved surface. Thus, each cancellation portion is brought into engagement with a hook portion of the corresponding elastic retaining piece portion to elastically deform the elastic retaining piece portion outwardly, and also the hook portion is disengaged from the retaining portion, thus canceling the retained condition of the pivotal lever. In the condition in which the cam pin abuts against the slanting surface, the fitting operation further proceeds, so that the slanting surface is pressed by the cam pin, and therefore the pivotal lever is pivotally displaced from the initial position toward the fitting position.

Incidentally, in recent years, a pivotal lever made of a thin metal sheet has been used because of a compact design of connectors. Elastic retaining piece portions as disclosed in the above JP-A-2003-264035 and JP-A-2003-264036 can be provided at such a metal-made pivotal lever. However, such elastic retaining piece portions are formed by stamping relevant portions out of a pivotal lever body and then by raising these stamped-out portions. Therefore, when a fitting operation and a fitting cancellation operation are repeatedly effected, the elastic retaining piece portions are susceptible to permanent set in fatigue. And besides, a metallic operating portion of the pivotal lever is touched with the fingers of the operator, and therefore is liable to be rusted.

SUMMARY OF THE INVENTION

This invention has been made in view of the above circumstances, and an object of the invention is to provide a pivotal lever-type connector having a pivotal lever which is higher in rigidity than a pivotal lever made entirely of metal, and has elastic retaining portions which are prevented from permanent set in fatigue, and also are prevented from being rusted.

The above object has been achieved by a pivotal lever-type connector of the present invention comprising one connector housing, a pivotal lever pivotally supported on the one connector housing, and the other connector housing, wherein the pivotal lever is engaged with engagement portions of the other connector housing, and the pivotal lever is pivotally moved, thereby fitting the one connector housing and the other connector housing together; characterized in that:

the one connector housing includes a hood portion for receiving part of the other connector housing; and the pivotal lever includes a metallic pivotal lever body which is disposed generally in straddling relation to the hood portion of the one connector housing, and can be engaged with the engagement portions, and a synthetic resin-made pivotal movement operating portion formed integrally with the pivotal lever body to cover a pivotally-moving end portion of the pivotal lever body; and the pivotal movement operating portion has a pair of synthetic resin-made elastic retaining arms formed integrally with a body of the pivotal movement operating portion; and the other connector housing includes a hood portion for receiving part of the one connector housing, and a pair of first inclining surfaces which are formed on an outer surface of the hood portion of the other connector housing so as to abut respectively against the elastic retaining arms; and the hood portion of the one connector housing has a pair of second inclining surfaces which are formed on an outer surface thereof, and extend in respective directions to decrease the distance therebetween; and at the same time when the one connector housing is fitted into a predetermined position relative to the other connector housing, so that the one connector housing and the other connector housing are brought into a provisionally-fitted condition, the elastic retaining arms, after abutting respectively against the first inclining surfaces, are guided respectively onto the second inclining surfaces, and slide on the respective second inclining surfaces in the respective directions to decrease the distance therebetween, so that the pivotal lever is pivotally moved, thereby canceling the provisionally-fitted condition.

In the pivotal lever-type connector of this construction, the pivotal lever includes the metallic pivotal lever body which is disposed generally in straddling relation to the hood portion of the one connector housing, and can be engaged with the engagement portions, and the synthetic resin-made pivotal movement operating portion formed integrally with the pivotal lever body to cover a pivotally-moving end portion of the pivotal lever body, and the pivotal movement operating portion has the pair of synthetic resin-made elastic retaining arms formed integrally with the body of the pivotal movement operating portion, and the synthetic resin-made elastic retaining arms serve as elastic retaining piece portions. Therefore, as compared with a pivotal lever made entirely of metal, the pivotal lever of the invention is higher in rigidity, and the elastic retaining arms are prevented from permanent set in fatigue. And besides, in the pivotal lever-type connector of this construction, the synthetic resin-made pivotal movement operating portion prevents the surface of the metallic pivotal lever body (on which this pivotal movement operating portion is mounted) from being rusted. The pivotal movement operating portion may be molded integrally on the pivotal lever body or may be mounted in a fitted manner on the pivotal lever body. Also, the elastic retaining arms may be molded integrally with the body of the pivotal movement operating portion or may be mounted in a fitted manner on the body of the pivotal movement operating portion. When the pivotally-moving end portion of the pivotal lever body is covered with the pivotal movement operating portion made of an insulative synthetic resin, the operator is prevented from getting an electric shock.

In the present invention, there can be provided the pivotal lever-type connector having the pivotal lever which is higher in rigidity than a pivotal lever made entirely of metal, and has the elastic retaining portions which are prevented from permanent set in fatigue, and also are prevented from being rusted.

The invention has been briefly described above. Details of the invention will become more manifest upon reading the following Section "DETAILED DESCRIPTION OF THE PREFERRED EMBODIMENTS" with reference to the accompanying drawings.

DETAILED DESCRIPTION OF THE PREFERRED EMBODIMENTS

A preferred embodiment of the present invention will now be described in detail with reference to the drawings.

Figure 1:
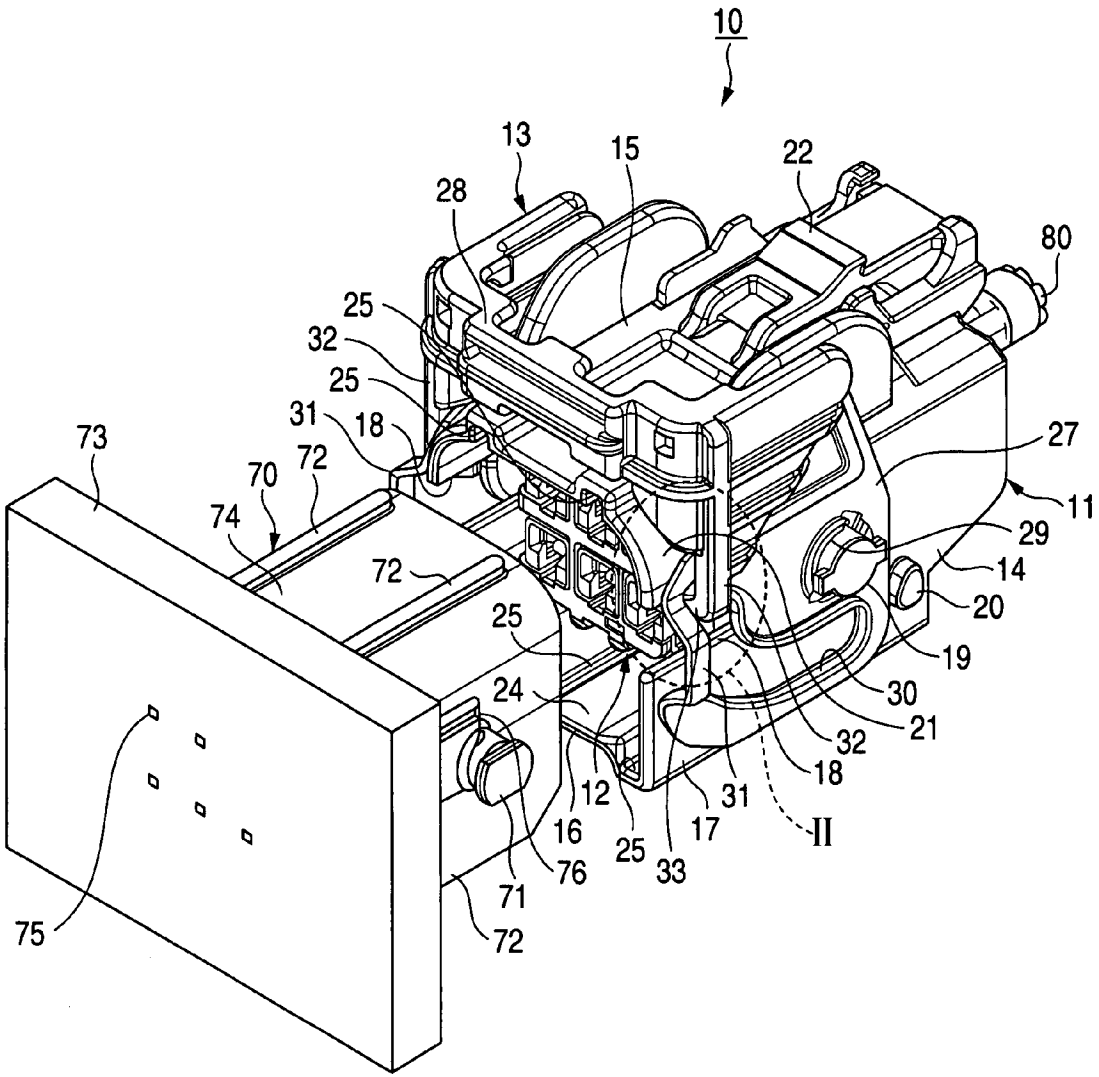
FIG. 1 is a perspective view showing one preferred embodiment of a pivotal lever-type connector of the present invention before a fitted condition is achieved.
Figure 2:
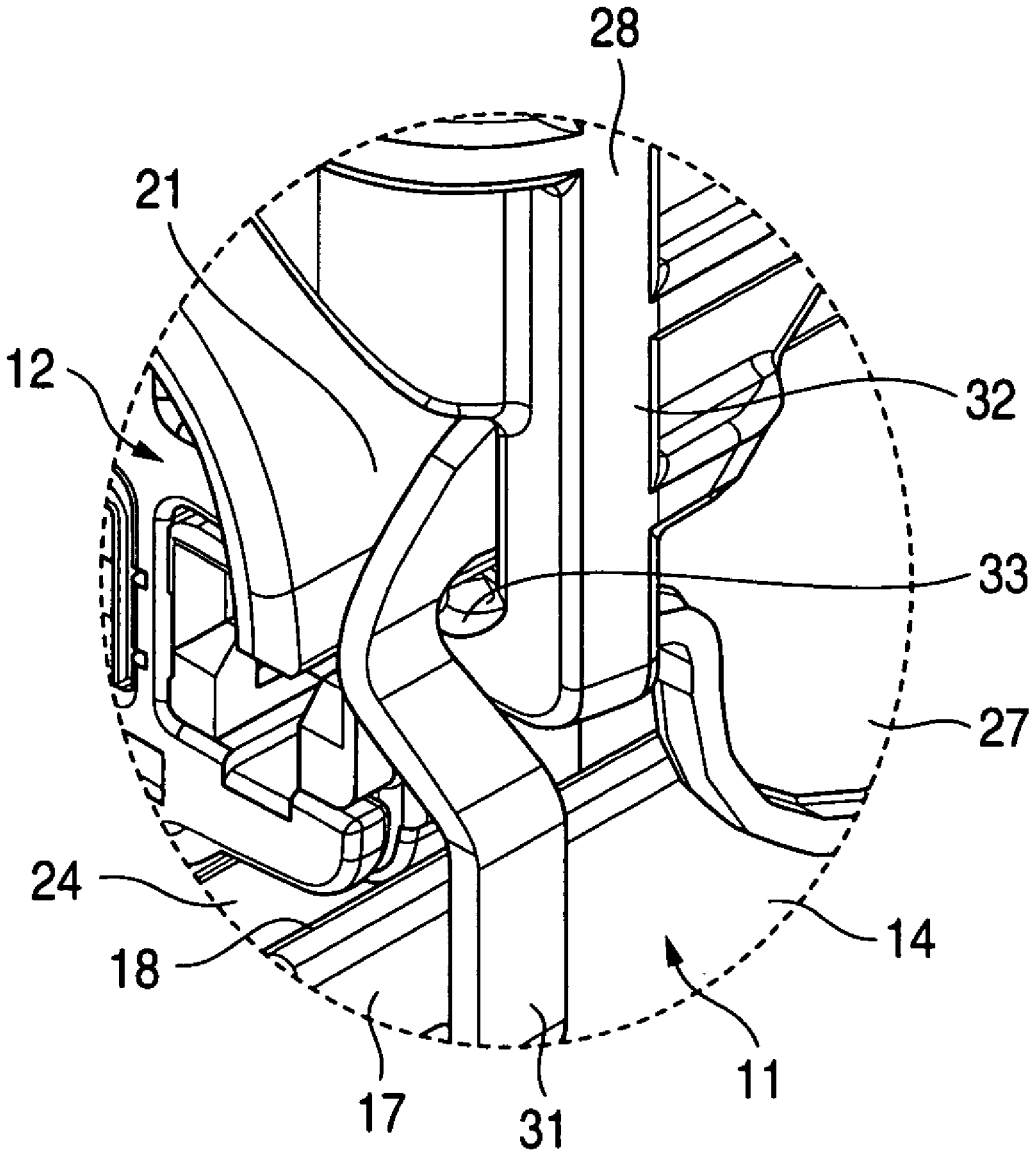
FIG. 2 is an enlarged view of a portion of the pivotal lever-type connector encircled by a broken line II of FIG. 2, showing an elastic retaining arm and its surroundings.
Figure 3:
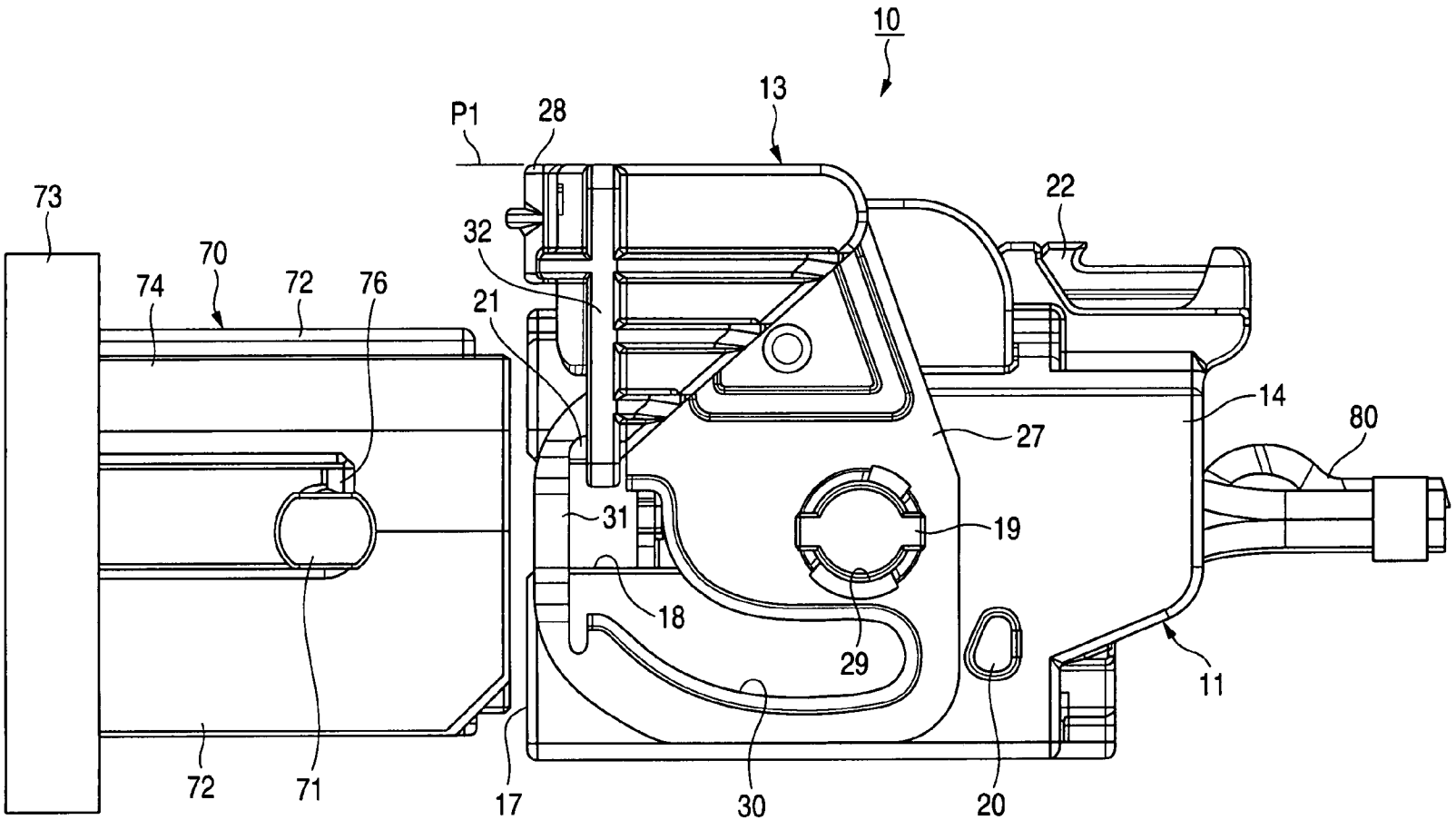
FIG. 3 is a right side-elevational view of the pivotal lever-type connector of FIG. 1.
Figure 4:
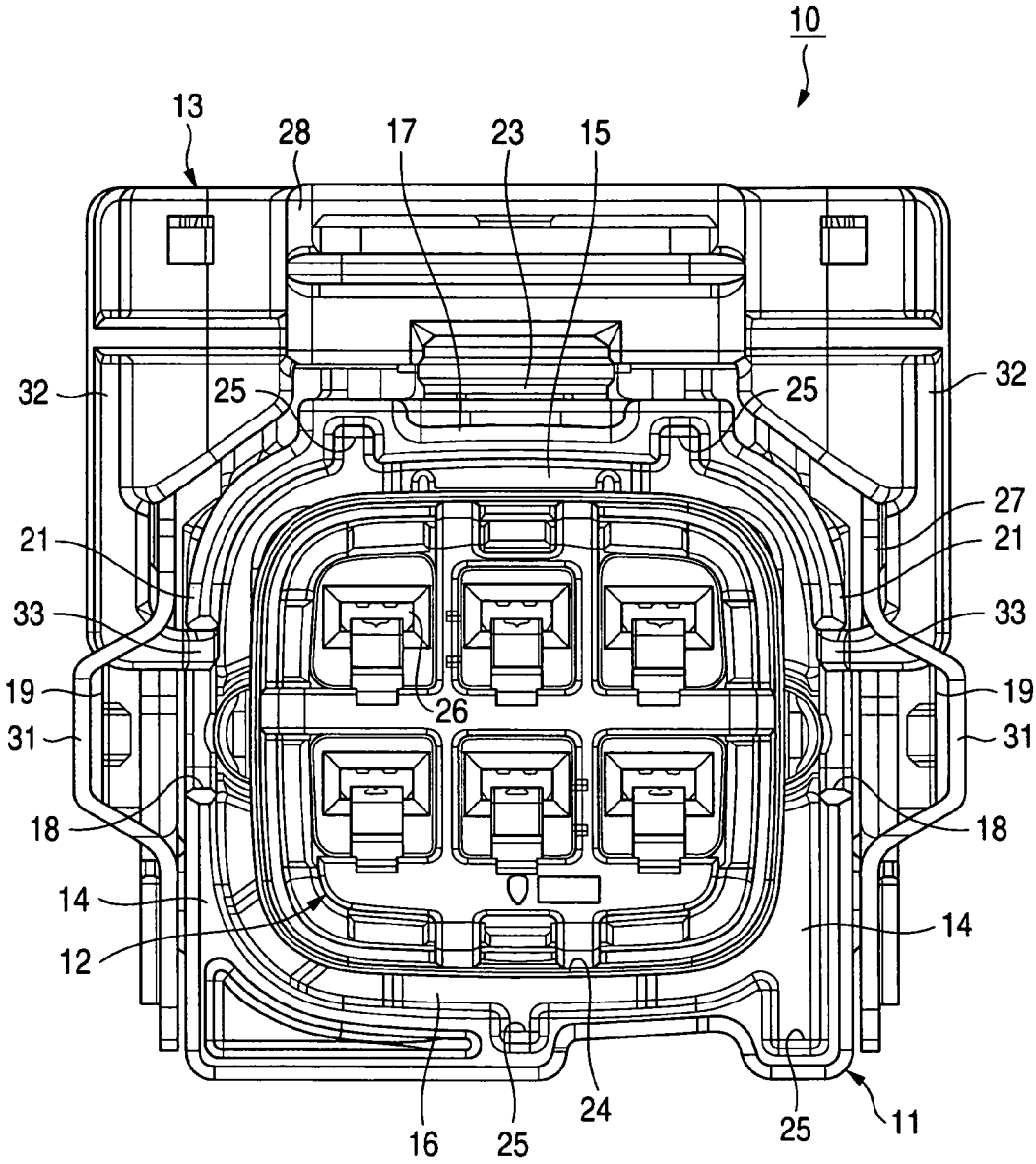
FIG. 4 is a front-elevational view of the pivotal lever-type connector of FIG. 1, mainly showing a female connector housing, an inner housing and a pivotal lever.
Figure 5:
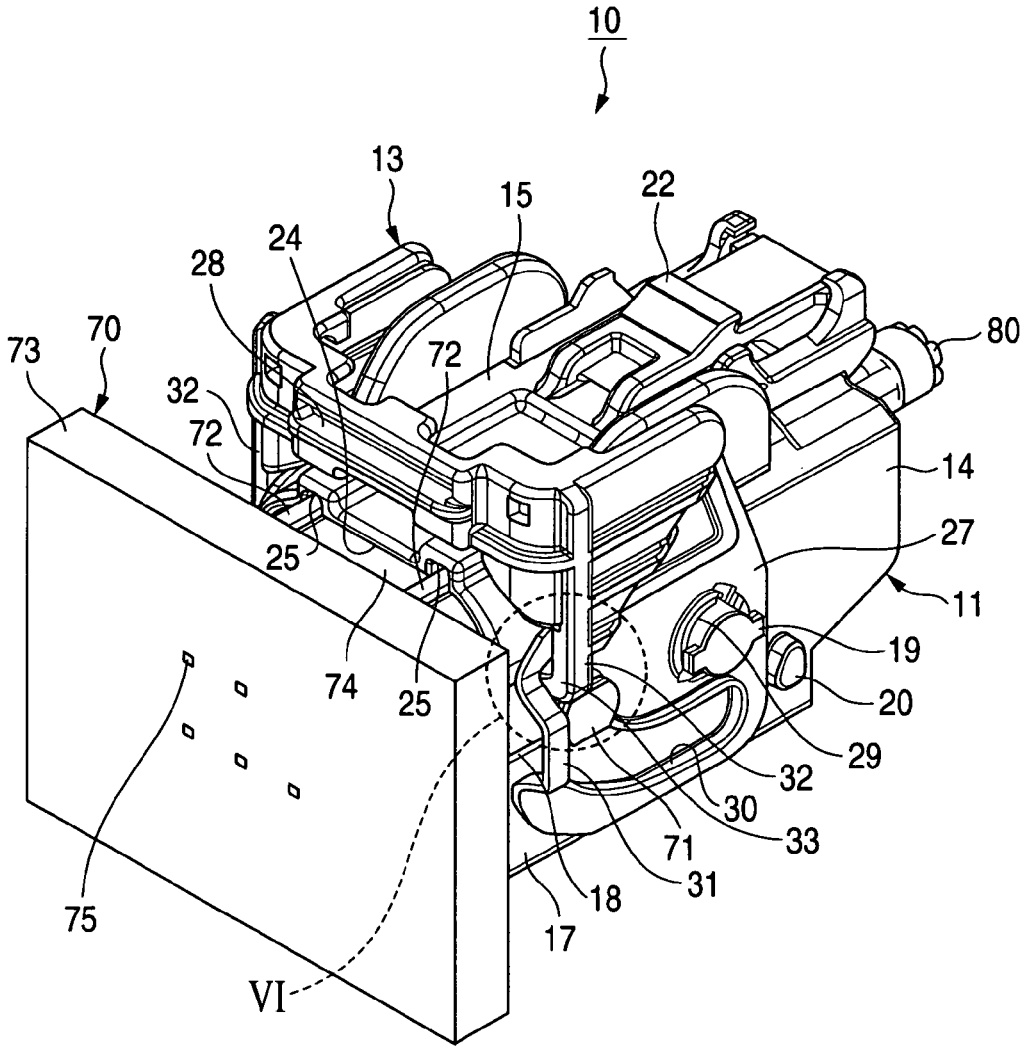
FIG. 5 is a perspective view of the pivotal lever-type connector of FIG. 1 immediately before a provisionally-fitted condition is achieved.
Figure 6:
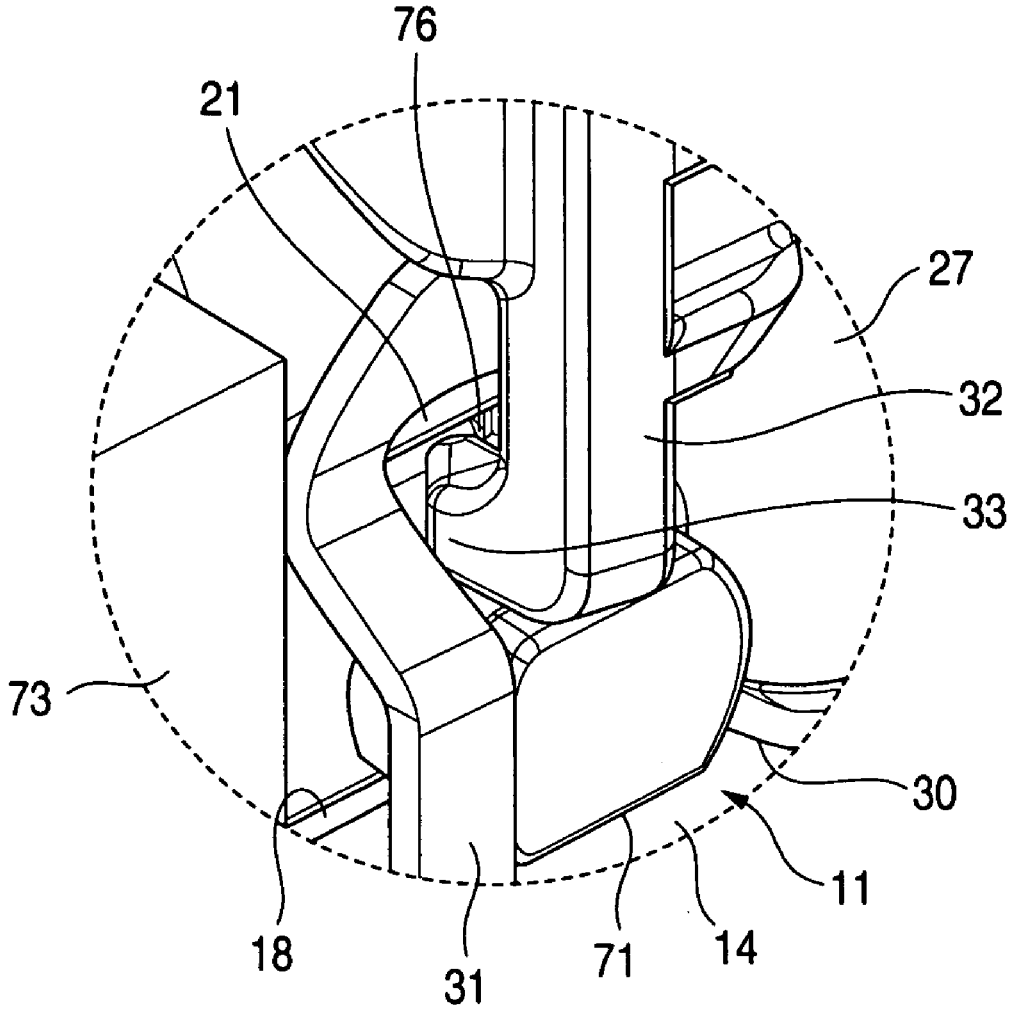
FIG. 6 is an enlarged view of a portion encircled by a broken line VI of FIG. 5.
Figure 7:
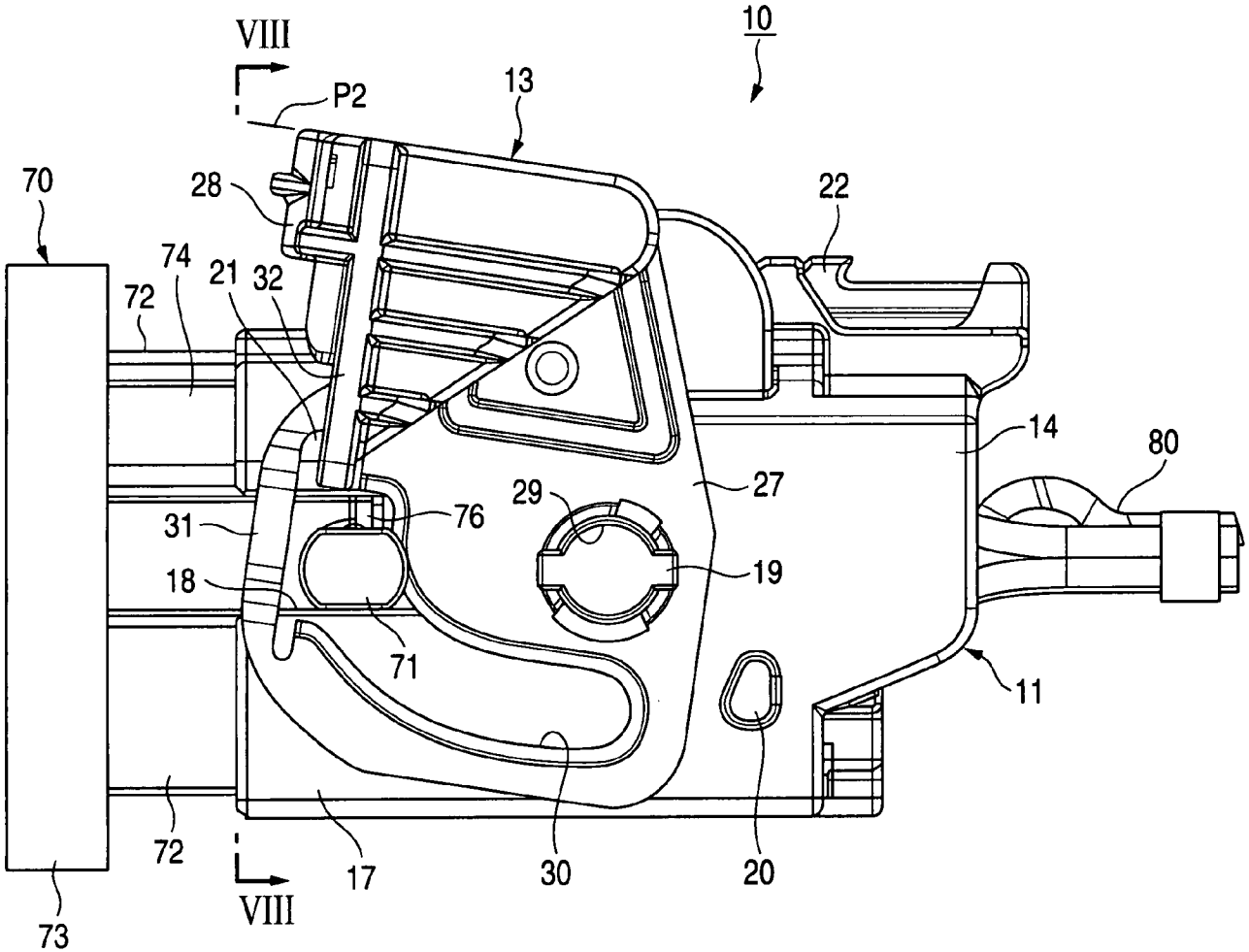
FIG. 7 is a perspective view of the pivotal lever-type connector of FIG. 5 at the time of canceling the provisionally-fitted condition.
Figure 8:
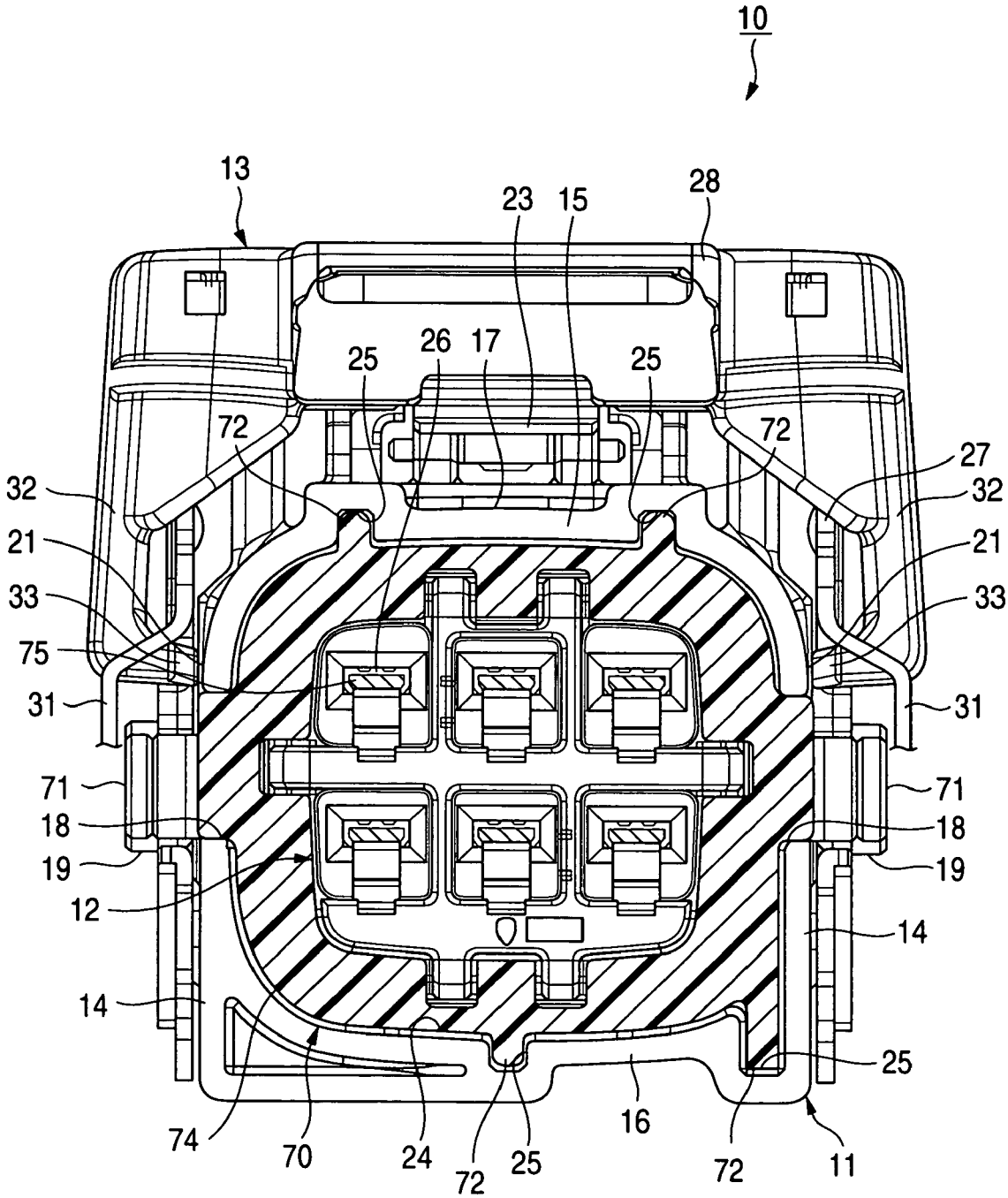
FIG. 8 is a cross-sectional view taken along the line VIII—VIII of FIG. 7.
Figure 9:
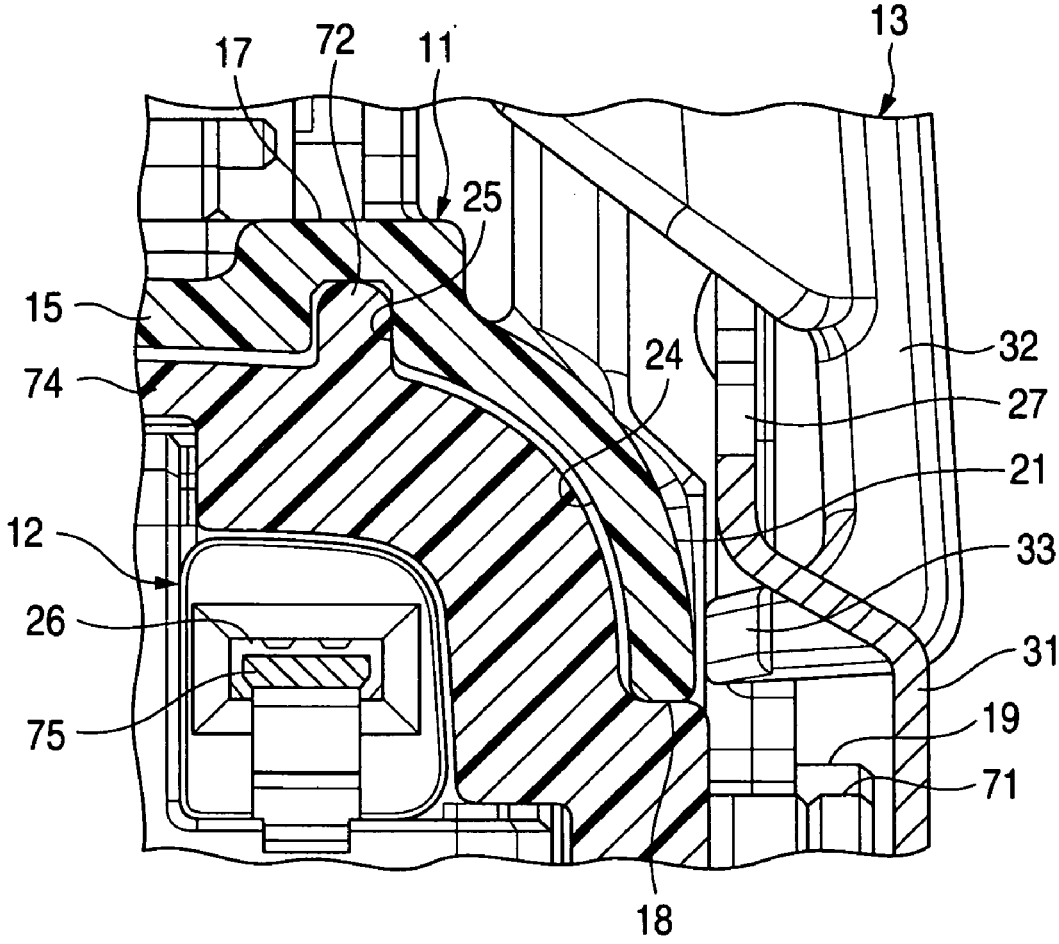
FIG. 9 is a cross-sectional view taken along a line (which is closer to a rear end of the female connector housing than the line VIII—VIII (for FIG. 8) is), showing an important portion (including the elastic retaining arm and its surroundings).
Figure 10:
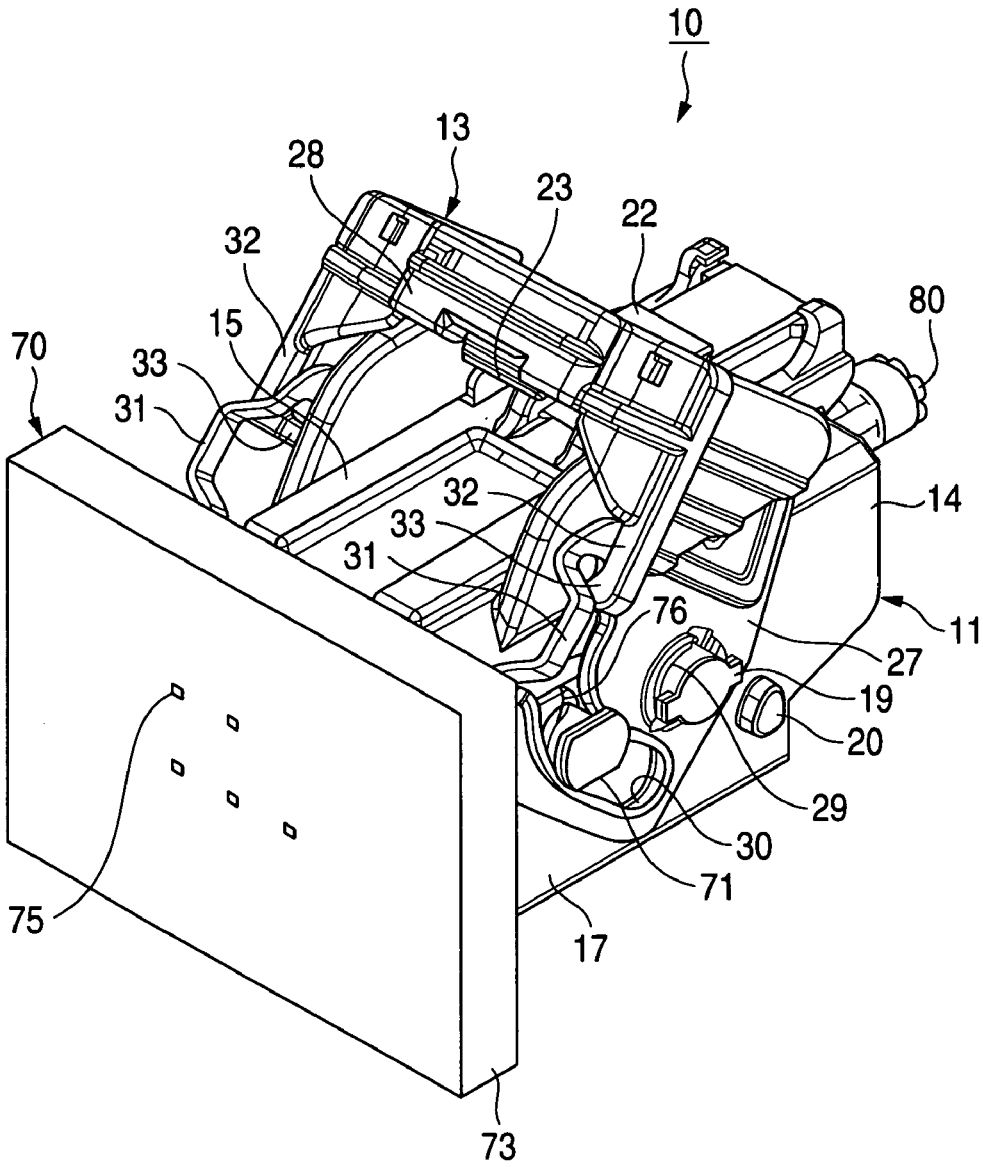
FIG. 10 is a perspective view of the pivotal lever-type connector of FIG. 7 after the provisionally-fitted condition is canceled.
Figure 11:
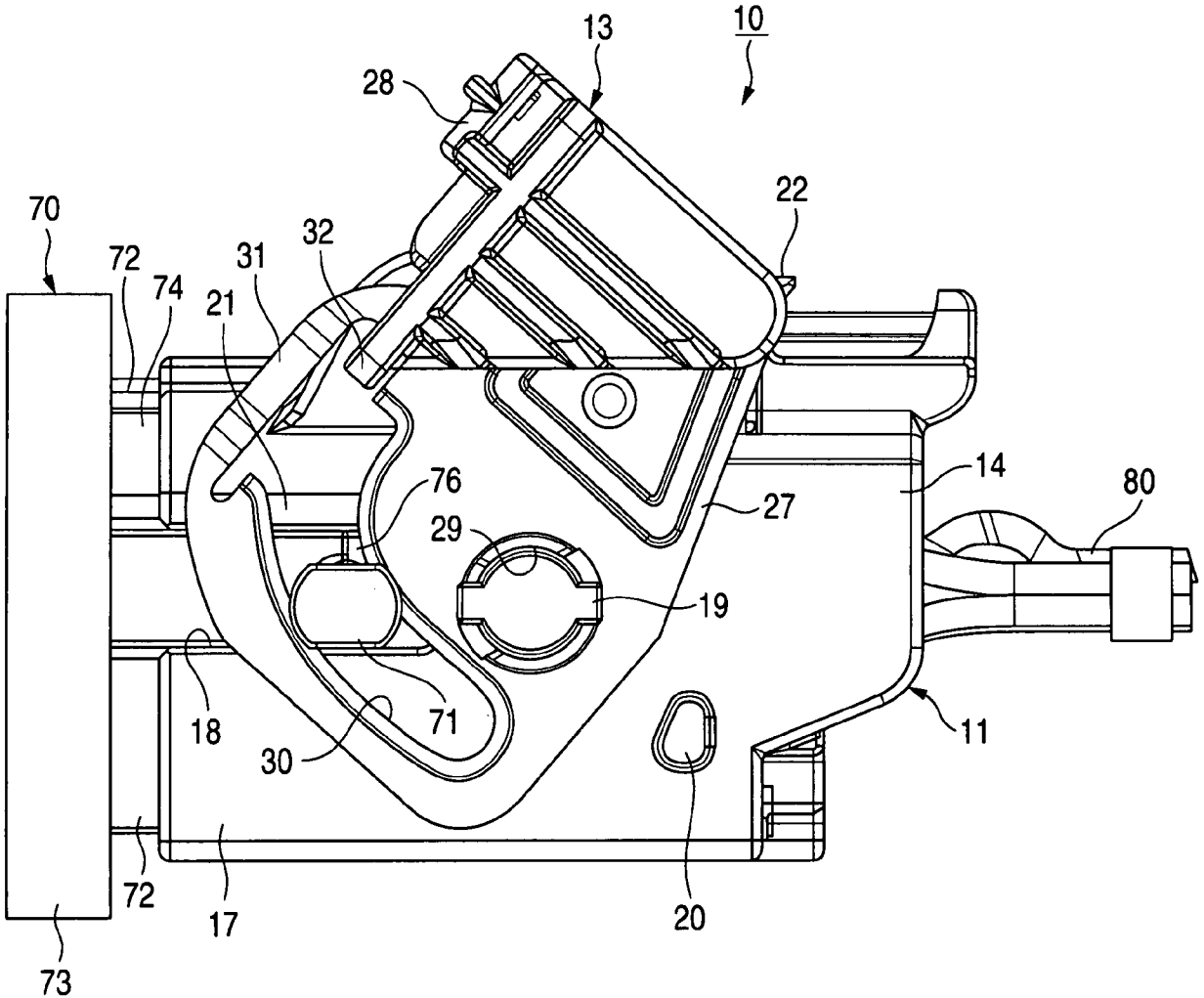
FIG. 11 is a right side-elevational view of the pivotal lever-type connector of FIG. 10.
Figure 12:
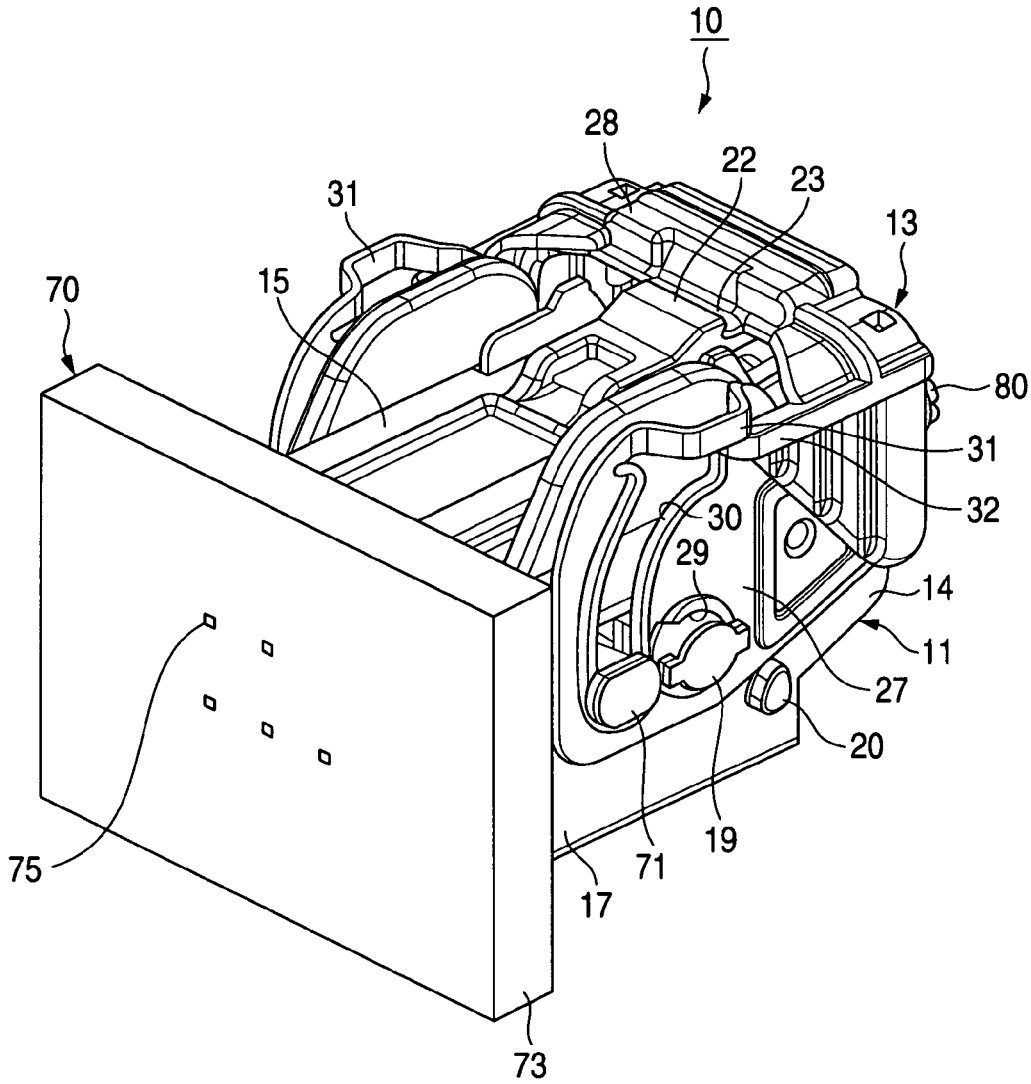
FIG. 12 is a perspective view of the pivotal lever-type connector of FIG. 10 in its completed-fitted condition.
Figure 13:
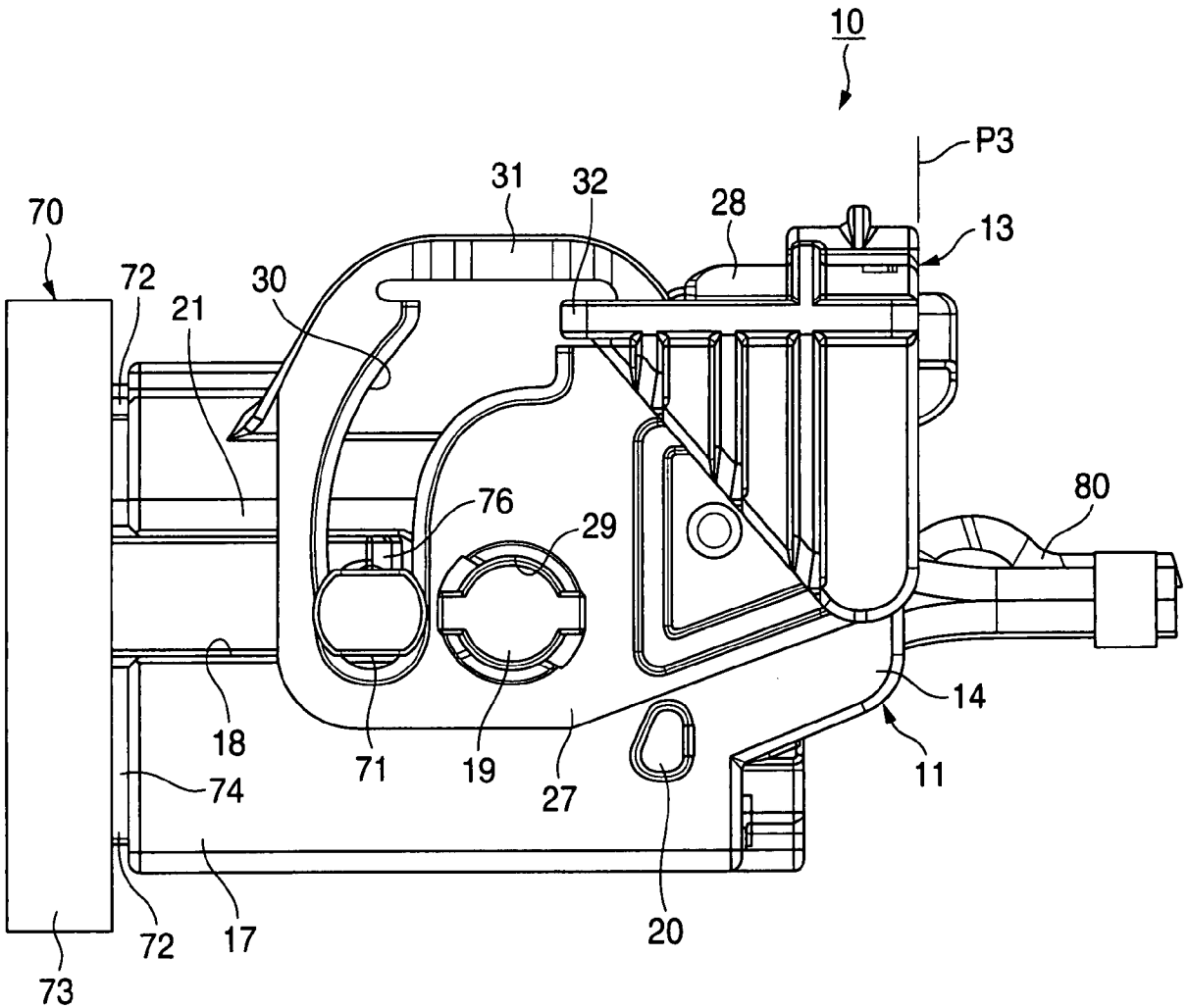
FIG. 13 is a right side-elevational view of the pivotal lever-type connector of FIG. 12.

FIG. 1 is a perspective view showing one preferred embodiment of a pivotal lever-type connector of the invention before a fitted condition is achieved, FIG. 2 is an enlarged view of a portion of the pivotal lever-type connector encircled by a broken line II of FIG. 2, showing an elastic retaining arm and its surroundings, FIG. 3 is a right side-elevational view of the pivotal lever-type connector of FIG. 1, FIG. 4 is a front-elevational view of the pivotal lever-type connector of FIG. 1, mainly showing a female connector housing, an inner housing and a pivotal lever, FIG. 5 is a perspective view of the pivotal lever-type connector of FIG. 1 immediately before a provisionally-fitted condition is achieved, FIG. 6 is an enlarged view of a portion encircled by a broken line VI of FIG. 5, FIG. 7 is a perspective view of the pivotal lever-type connector of FIG. 5 at the time of canceling the provisionally-fitted condition, FIG. 8 is a cross-sectional view taken along the line VIII—VIII of FIG. 7, FIG. 9 is an enlarged cross-sectional view taken along a line (which is closer to a rear end of the female connector housing than the line VIII—VIII (for FIG. 8) is), showing an important portion (including the elastic retaining arm and its surroundings), FIG. 10 is a perspective view of the pivotal lever-type connector of FIG. 7 after the provisionally-fitted condition is canceled, FIG. 11 is a right side-elevational view of the pivotal lever-type connector of FIG. 10, FIG. 12 is a perspective view of the pivotal lever-type connector of FIG. 10 in its completed-fitted condition, and FIG. 13 is a right side-elevational view of the pivotal lever-type connector of FIG. 12.

As shown in FIGS. 1 to 13, one preferred embodiment of the pivotal lever-type connector 10 of the invention comprises the female connector housing 11 having the inner housing 12, the pivotal lever 13 pivotally supported on the female connector housing 11, and a male connector housing 70. In this pivotal lever-type connector, the pivotal lever 13 is engaged with engagement projections 71 of the male connector housing 70, and the pivotal lever 13 is pivotally moved, thereby fitting the female connector housing 11 and the male connector housings 70 together.

The female connector housing 11 has a hood portion 17 for receiving part of the male connector housing 70. The pivotal lever 13 includes a pair of plate-like pivotal lever body portions 27 which are opposed to each other with the hood portion 17 of the female connector housing 11 disposed therebetween, and can be engaged respectively with the engagement projections 71, a pivotal movement operating portion 28 extending between pivotally-moving end portions of the pivotal lever body portions 27, and the pair of elastic retaining arms 32 provided at the pivotal movement operating portion 28.

The male connector housing 70 includes a hood portion 74 for receiving part of the female connector housing 11, and a pair of male connector housing-side inclining surfaces 76 which are formed on an outer surface of the hood portion 74 so as to abut respectively against the elastic retaining arms 32. On the other hand, the hood portion 17 of the female connector housing 11 has a pair of female connector housing-side inclining surfaces 21 which are formed on an outer surface thereof, and extend in respective directions to decrease the distance therebetween.

As is clear from FIGS. 7 to 9, in the pivotal lever-type connector 10 of this construction, at the same time when the female connector housing 11 is fitted into a predetermined position relative to the male connector housing 70 (in other words, when the male connector housing 70 is fitted into a predetermined position relative to the female connector housing 11), so that the female connector housing 11 and the male connector housing 70 are brought into the provisionally-fitted condition, the elastic retaining arms 32, after abutting respectively against the male connector housing-side inclining surfaces 76, are guided respectively onto the female connector housing-side inclining surfaces 21, and slide on the respective female connector housing-side inclining surfaces 21 in the respective directions to decrease the distance therebetween, so that the pivotal lever 13 is slightly pivotally moved, thereby canceling the provisionally-fitted condition.

Details of the pivotal lever-type connector 10 of this construction will be described below.

The female connector housing 11 is molded of an insulative synthetic resin, and includes the hood portion 17 of a generally square tubular shape having a pair of side plates 14, a top plate 15 and a bottom plate 16. Each of the two side plates 14 has a notch 18 extending from an end edge thereof in the fitting direction. The pair of engagement projections 71, formed on and projecting respectively from opposite side surfaces of the male connector housing 70, are inserted respectively into the notches 18. Pivotal lever-pivotally supporting shafts 19 (serving as an axis of pivotal movement) are formed respectively on the pair of side plates 14 of the female connector housing 11, and further pivotal lever pivotal movement-limiting projections 20 for limiting the range of pivotal movement of the pivotal lever 13 are formed respectively on the pair of side plates 14.

The hood portion 17 has the female connector housing-side inclining surfaces 21 which are continuous respectively with edges of the notches 18. Each of the female connector housing-side inclining surfaces 21 is part of a curved outer peripheral surface of the hood portion 17.

The top plate 15 has a pivotal lever lock portion 22 disposed at a lock-side end of the range of pivotal movement of the pivotal lever 13. When the pivotal lever 13 is pivotally moved into a completely-fitting position, a lock piece portion 23 (see FIG. 4), formed on the pivotal lever 13, is brought into snapping engagement with the pivotal lever lock portion 22, thereby locking the pivotal lever 13. On the other hand, when the pivotal lever lock portion 22 is pressed in the locked condition of the pivotal lever 13, the lock piece 23 of the pivotal lever 13 is disengaged from the pivotal lever lock portion 22, thereby canceling the locked condition.

The female connector housing 11 has a male connector housing insertion portion 24 disposed inside the pair of side plates 14 and 14, the top plate 15 and the bottom plate 16. This male connector housing insertion portion 24 has four guide grooves 25 extending in the fitting direction so as to respectively receive and guide four insertion projections 72 formed on the outer peripheral surface of the male connector housing 70 and extending in the fitting direction.

The inner housing 12 is made of an insulative synthetic resin, and has six female terminals 26 (see FIG. 4) received respectively in terminal receiving portions (not shown). A waterproof O-ring (not shown) is fitted on the inner housing 12. When the female connector housing 11 and the male connector housing 70 are fitted together, the female terminals 26 contact respective male terminals 75 (see FIG. 8) within the male connector housing 70, and are electrically connected thereto. Wire connection portions (not shown) of the female terminals 26, disposed remote from a fitting portion of the inner housing 12, are electrically connected to a wire harness 80.

The pivotal lever 13 is a connector fitting-operation support member, and includes the pair of pivotal lever body portions 27, and a bridge plate extending between the pivotally-moving end portions of the pivotal lever body portions 27 (The pivotal lever portions 27 and the bridge plate are formed by pressing a relatively-thin metal plate or sheet into a generally U-shape), and the pivotal movement operating portion 28 of a generally U-shape mounted integrally on the pivotal lever body portions 27 and the bridge plate to cover them. The pivotally-moving end portions of the pivotal lever body portions 27 are interconnected by the bridge plate in such a manner that the body portions 27 and the bridge plate are integrally connected together in an uninterrupted manner, and part of this bridge plate is exposed from the pivotal movement operating portion 28 to form the lock piece portion 23.

Each of the pivotal lever body portions 27 includes a pivot hole 29 for the passage of the pivotal lever-pivotally supporting shaft 19 therethrough, a cam groove 30 which is disposed outwardly of the pivot hole 29, and is formed into a curved shape, and can be engaged with the engagement projection 71 of the male connector housing 70 so as to move the female connector housing 11 toward the male connector housing 70 in accordance with the pivotal movement of the pivotal lever 13 during the fitting operation, and a guide 31 for guiding the engagement projection 71 of the male connector housing 70 into the cam groove 30 at the time of effecting the fitting operation.

The pivotal movement operating portion 28 is made of an insulative synthetic resin having high elasticity, and has the elastic retaining arms 32 and 32 formed respectively at opposite side portions thereof. The elastic retaining arms 32 and 32 are synthetic resin-molded portions molded integrally with a body of the pivotal movement operating portion 28, and extend or depend from the body of the pivotal movement operating portion 28 respectively toward the guides 31.

The male connector housing 70 is molded of an insulative synthetic resin, and has the hood portion 74 of a generally square tubular shape formed on and projecting from a base portion 73. The six male terminals 75, fixed to the base portion 73, are disposed within the hood portion 74. Wire connection portions (not shown) of the male terminals 75, disposed near to the base portion 73, are electrically connected to a wire harness (not shown). The hood portion 74 has the four insertion projections 72 formed on the outer peripheral surface thereof and extending in the fitting direction, and also has the pair of engagement projections 71 formed respectively on the opposite side surfaces thereof. The hood portion 74 has the pair of male connector housing-side inclining surfaces 76 disposed immediately adjacent respectively to the pair of engagement projections 71. The male connector housing-side inclining surfaces 76 are tapering in a manner to increase in width gradually in the direction of fitting (or advancing) of the female connector housing 11. Therefore, when the female connector housing 11 is to be brought into the provisionally-fitted condition, the male connector housing-side inclining surfaces 76 abut respectively against the elastic retaining arms 32 of the pivotal movement operating portion 28, and elastically deform these arms 32 to increase the distance between these arms 32, thereby canceling the provisionally-fitted condition.

As shown in FIG. 2, distal end portions 33 (each projecting to assume a generally L-shape) of the elastic retaining arms 32 of the pivotal movement operating portion 28 are disposed respectively within the notches 18 formed in the female connector housing 11. When the hood portion 74 of the male connector housing 70 begins to enter the hood portion 17 of the female connector housing 11 in the fitting direction, the engagement projections 71 of the male connector housing 70 begin to enter the respective notches 18 in the female connector housing 11, and before the provisionally-fitted condition is achieved, the elastic retaining arms 32 abut respectively against the male connector housing-side inclining surfaces 76.

In the pivotal lever-type connector 10, before the fitting operation is effected, the pivotal lever 13 is disposed in a non-fitting position P1 as shown in FIG. 3, and the guides 31 as well as the notches 18 of the female connector housing 11 are directed toward the respective engagement projections 71 of the male connector housing 70.

As shown in FIG. 4, the male connector housing insertion portion 24 of a generally annular shape is formed between the hood portion 17 and the inner housing 12 of the female connector housing 11.

When effecting the provisionally-fitting operation, the terminal receiving portions of the inner housing 12 are aligned respectively with the male terminals 75 disposed within the hood portion 74 of the male connector housing 70 and projecting in the fitting direction, and also the guide grooves 25 of the female connector housing 11 are fitted respectively on the insertion projections 72 of the male connector housing 70, and further the guides 31 of the pivotal lever 13 as well as the notches 18 of the female connector housing 11 are disposed in registry with the engagement projections 71 of the male connector housing 70, respectively, and in this condition the hood portion 74 of the male connector housing 70 is pushed and inserted into the male connector housing insertion portion 24 formed between the female connector housing 11 and the inner housing 12, as shown in FIG. 5.

As shown in FIG. 6, the hood portion 74 of the male connector housing 70 is thus pushed and inserted between the female connector housing 11 and the inner housing 12, and after the engagement projections 71 pass respectively past the guides 31 of the pivotal lever 13, the distal end portions 33 of the elastic retaining arms 32 of the pivotal lever 13 abut respectively against the male connector housing-side inclining surfaces 76 of the male connector housing 70, so that the elastic retaining arms 32 are elastically deformed, thereby increasing the distance between these elastic retaining arms 32. Thereafter, when the hood portion 74 of the male connector housing 70 is further inserted into a predetermined position within the male connector housing insertion portion 24, the provisionally-fitted condition is achieved. However, this provisionally-fitted condition is instantaneously canceled by the sliding movement of the distal end portions 33 of the elastic retaining arms 32 over the respective female connector housing-side inclining surfaces 21 as shown in FIG. 7.

As shown in FIG. 7, the distal end portions 33 of the elastic retaining arms 32 (which have been elastically deformed upon abutting of the distal end portions 33 against the respective male connector housing-side inclining surfaces 76, so that a resilient force has been accumulated in each elastic retaining arm 32) are guided to the respective female connector housing-side inclining surfaces 21 of the hood portion 17 of the female connector housing 11 through the respective male connector housing-side inclining surfaces 76. When the distal end portions 33 of the elastic retaining arms 32 shift onto the respective female connector housing-side inclining surfaces 21 disposed in continuous relation to the upper edges of the respective notches 18, the elastic retaining arms 32 are elastically restored in a manner to decreases the distance therebetween, and slide on and along the respective female connector housing-side inclining surfaces 21 under the influence of the accumulated resilience forces (that is, their restoring forces), so that the pivotal lever 13 is pushed at once into a provisionally-fitting cancellation position P2.

As shown in more detail in FIGS. 8 and 9, when the distal end portion 33 of each elastic retaining arm 32 shifts from the male connector housing-side inclining surface 76 to the female connector housing-side inclining surface 21, reaction forces, resulting from the sliding contact of the elastic retaining arms 32 (having the accumulated resilience forces) with the respective female connector housing-side inclining surfaces 21 of a curved shape, are imparted to the pivotal lever 13, thereby pushing the pivotal lever 13 toward the provisionally-fitting cancellation position P2.

As shown in FIG. 10, the pivotal lever 13, pushed toward the provisionally-fitting cancellation position P2, is manually pivotally moved toward a completely-fitting position P3 (see FIG. 13) by the operator.

As the pivotal lever 13 is thus pivotally moved from the provisionally-fitting cancellation position P2 toward the completely-fitting position P3, the distance between the center (or axis) of each pivotal lever-pivotally supporting shaft 19 and the corresponding engagement projection 71 within the cam groove 30 is decreasing, so that the fitting of the female connector housing 11 and the male connector housing 70 relative each other proceeds as shown in FIG. 11.

When each engagement projection 71 reaches the closed end portion of the corresponding cam groove 30 in the pivotal lever 13 as shown in FIG. 12, the lock piece portion 23 of the pivotal lever 13 is retained by the pivotal lever lock portion 22 of the female connector housing 11, so that the completely-fitted condition is achieved.

The pivotal lever 13 is locked in the completely-fitting position P3 as shown in FIG. 13, and therefore the engagement projections 71 of the male connector housing 70 are prevented by the respective cam grooves 30 from withdrawal, and the fitting of the male and female connector housings 70 and 11 is finished. At this time, the female terminals 26 within the inner housing 12 are electrically connected respectively to the male terminals 75 within the male connector housing 70, and a circuit is formed by the wire harness 80, connected to the female connector housing 11, and the wire harness connected to the male connector housing 70.

Thus, the distal end portion 33 of each of the elastic retaining arms 32 is successively brought into sliding contact with the male connector housing-side inclining surface 76 and the female connector housing-side inclining surface 21, so that the provisionally-fitted condition is automatically canceled, and the pivotal lever 13 is pushed out toward the completely-fitting position P3. Therefore, the operator is merely required to pivotally move the thus pushed-out pivotal lever 13 into the completely-fitting position P3 with a small pushing force.

As described above, in the pivotal lever-type connector 10, the pivotal lever 13 includes the metallic pivotal lever body (pivotal lever body portions) 27 which is disposed generally in straddling relation to the hood portion 17 of the female connector housing 11, and can be engaged with the engagement projections 71 of the male connector housing 70, and the synthetic resin-made pivotal movement operating portion 28 mounted on the pivotal lever body 27 to cover the pivotally-moving end portion of the pivotal lever body, and the pivotal movement operating portion 28 has the pair of synthetic resin-made elastic retaining arms 32 formed integrally with the body of the pivotal movement operating portion 28, and the synthetic resin-made elastic retaining arms 32 serve as elastic retaining piece portions. Therefore, as compared with a pivotal lever made entirely of metal, the pivotal lever of the invention is higher in rigidity, and the elastic retaining arms are prevented from permanent set in fatigue. And besides, in the pivotal lever-type connector 10, the synthetic resin-made pivotal movement operating portion 28 prevents the surface of the metallic pivotal lever body 27 (on which this pivotal movement operating portion is mounted) from being rusted.

Furthermore, in the pivotal lever-type connector 10, at the same time when the female connector housing 11 is fitted into the predetermined position relative to the male connector housing 70 (in other words, when the male connector housing 70 is fitted into the predetermined position relative to the female connector housing 11), so that the female connector housing 11 and the male connector housing 70 are provisionally fitted together, the distal end portions 33 of the elastic retaining arms 32, after abutting respectively against the male connector housing-side inclining surfaces 76, are guided respectively onto the female connector housing-side inclining surfaces 21, and slide on the respective female connector housing-side inclining surfaces 21 in the respective directions to decrease the distance therebetween, so that the pivotal lever 13 is slightly pivotally moved, thereby canceling the provisionally-fitted condition. Therefore, when canceling the provisionally-fitted condition, an operating force, large enough to cause the cam pins to slide over the respective projecting portions, does not need to be applied to the pivotal lever manually by the operator as in the conventional construction, and therefore the pivotal lever can be easily pivotally moved so as to completely fit the female connector housing 11 and the male connector housing 70 together. Thus, the pivotal lever-type connector 10 can cancel the provisionally-fitted condition by itself, and therefore the series of fitting operations can be easily effected.

The present invention is not limited to the above embodiment, and suitable modifications, improvements, etc., can be made. Furthermore, the material, shape, dimensions, numerical value, form, number, disposition, etc., of each of the constituent elements of the above embodiment are arbitrary, and are not limited in so far as the invention can be achieved.

What is claimed is:

1. A pivotal lever-type connector comprising:

a first connector housing, a pivotal lever pivotally supported on said first connector housing, and a second connector housing, wherein said pivotal lever is engaged with engagement portions of said second connector housing, and said pivotal lever is pivotally moved, thereby fitting said first connector housing and said second connector housing together;

wherein said first connector housing includes a hood portion for receiving a part of said second connector housing; and said pivotal lever includes a metallic pivotal lever body which is disposed generally in straddling relation to said hood portion of said first connector housing, and can be engaged with said engagement portions, and a synthetic resin-made pivotal movement operating portion formed integrally with said pivotal lever body to cover a pivotally-moving end portion of said pivotal lever body; and said pivotal movement operating portion has a pair of synthetic resin-made elastic retaining arms formed integrally with a body of said pivotal movement operating portion; and said second connector housing includes a hood portion for receiving a part of said first connector housing, and a pair of first inclining surfaces which are formed on an outer surface of said hood portion of said second connector housing so as to abut respectively against said elastic retaining arms; and said hood portion of said first connector housing has a pair of second inclining surfaces which are formed on an outer surface thereof, and extend in respective directions to decrease the distance therebetween; and at the same time when said first connector housing is fitted into a predetermined position relative to said second connector housing, so that said first connector housing and said second connector housing are brought into a provisionally-fitted condition, said elastic retaining arms, after abutting respectively against said first inclining surfaces, are guided respectively onto said second inclining surfaces, and slide on the respective second inclining surfaces in the respective directions to decrease said distance therebetween, so that said pivotal lever is pivotally moved, thereby canceling said provisionally-fitted condition.

* * * * *